US005680978A

United States Patent [19]

Pinion

[11] Patent Number: 5,680,978

[45] Date of Patent: Oct. 28, 1997

[54] BABY BOTTLE LINER DISPENSING CABINET

[76] Inventor: Julie A. Pinion, 17199 E. Park Ave., Hammond, La. 70403

[21] Appl. No.: 532,076

[22] Filed: Sep. 22, 1995

[51] Int. Cl.[6] ..... B26F 3/02; B65D 85/671

[52] U.S. Cl. ..... 225/106; 225/39; 225/42; 225/47; 220/4.22; 220/230; 220/254; 242/598.6

[58] Field of Search ..... 225/39, 40, 42, 225/46, 47, 77, 106; 242/598.6; 220/4.22, 4.24, 230, 254, 337, 338, 476

[56] References Cited

U.S. PATENT DOCUMENTS

| | | | |
|---|---|---|---|
| 1,829,577 | 10/1931 | Anderson | 225/47 X |
| 1,912,363 | 6/1933 | Waide | 225/106 |
| 2,031,033 | 2/1936 | Denebeim | 225/47 |
| 2,750,029 | 6/1956 | Morgan | 225/47 X |
| 3,184,053 | 5/1965 | Eldridge | 242/598.6 X |
| 3,318,443 | 5/1967 | Hillis | 242/598.6 X |
| 3,893,609 | 7/1975 | Jamois et al. | 225/42 |
| 4,034,926 | 7/1977 | Wegner | 242/598.6 X |
| 4,088,276 | 5/1978 | Littleton | 225/46 X |
| 4,645,108 | 2/1987 | Gavin et al. | 225/103 |
| 5,118,022 | 6/1992 | Farahnik | 225/106 |
| 5,135,146 | 8/1992 | Simhaee | 225/80 |
| 5,170,958 | 12/1992 | Brown | 242/598.6 X |
| 5,299,723 | 4/1994 | Hempel | 225/42 X |
| 5,492,243 | 2/1996 | Brandhorst | 220/4.24 X |

FOREIGN PATENT DOCUMENTS

| | | | |
|---|---|---|---|
| 481680 | 4/1992 | European Pat. Off. | 225/39 |
| 686485 | 7/1930 | France | 2442 598.6 |
| 387571 | 6/1932 | United Kingdom | 225/42 |

*Primary Examiner*—Rinaldi I. Rada
*Assistant Examiner*—Clark F. Dexter
*Attorney, Agent, or Firm*—Joseph N. Breaux

[57] ABSTRACT

A baby bottle liner dispensing cabinet including a housing enclosure having a front housing member, including a dispensing slot, hingedly connected to a back housing member that is positionable in combination with the front housing member to form an internal liner roll enclosure; a liner roll support dowel positionable within the internal liner roll enclosure; and a sanitary door member pivotally secured to the exterior of the front housing member adjacent the dispensing slot and positively held in place over the dispensing slot by a positive force latching mechanism.

10 Claims, 3 Drawing Sheets

BABY BOTTLE LINER DISPENSING CABINET

TECHNICAL FIELD

The present invention relates to devices used to dispense sequentially attached items from a roll and more particularly to devices used to dispense sequentially attached items from a roll that have an enclosure within which the roll of items is maintained prior to dispensing.

BACKGROUND ART

One method of providing a supply of sanitary containers within which to store a supply of infant formula has been to utilize disposable, plastic, sanitary baby bottle liners placed within a secondary housing. The liners are generally sold with the liners sequentially attached to form a continuous roll. As each liner is required, it is torn free from the roll along perforations made along the junction between two liners.

Although such rolls of liners are convenient, they may themselves become contaminated through storage in drawers, diaper bags and counter tops prior to use. It would be desirable, therefore, to have a device for housing the roll of baby bottle liners in an enclosure that prevents contact between the roll and contaminants. It would be a further benefit if the device allowed an individual liner to be removed from the roll without necessitating contact with the roll by the user. It would be a further benefit if the device included a mechanism for allowing the user to mount the device in a location convenient for the preparation of baby bottles that allowed a user to remove an individual liner from the roll with the use of a single hand.

GENERAL SUMMARY DISCUSSION OF INVENTION

It is thus an object of the invention to provide a baby bottle liner dispensing cabinet that includes an enclosure for housing a roll of baby bottle liners that prevents contact between the roll and contaminants.

It is a further object of the invention to provide a baby bottle liner dispensing cabinet that allows an individual liner to be removed from the roll without necessitating contact with the roll by the user.

It is a still further object of the invention to provide a baby bottle liner dispensing cabinet that includes a mechanism for allowing the user to mount the device in a location convenient for the preparation of baby bottles.

It a still further object of the invention to provide a baby bottle dispensing cabinet that allows a user to remove an individual liner from the roll with the use of a single hand.

It is a still further object of the invention to provide a baby bottle liner dispensing cabinet that achieves all or some of the above objects in combination.

Accordingly, a baby bottle liner dispensing cabinet is provided. The dispensing cabinet comprises a housing enclosure having a front housing member, including a dispensing slot, hingedly connected to a back housing member that is positionable in combination with the front housing member to form an internal liner roll enclosure; a liner roll support dowel positionable within the internal liner roll enclosure; and a sanitary door member pivotally secured to the exterior of the front housing member adjacent the dispensing slot and positively held in place over the dispensing slot by a positive force latching mechanism.

The term positive force latching mechanism means a mechanism that positively biases the sanitary door member into a position covering the dispensing slot. Examples of such mechanisms would include torsion springs and magnetic closures. In a preferred embodiment of the dispensing cabinet, the positive force latching mechanism includes a first section of magnetic material and a second section of material that is attracted by magnetic force. One of the first or second sections is secured to the sanitary door member and the other section is secured to the front housing member. The attraction between the first and second sections is sufficient to maintain the sanitary door member in position over the dispensing slot, once placed in that position, against a force at least equal to the force of gravity acting on the sanitary door member.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
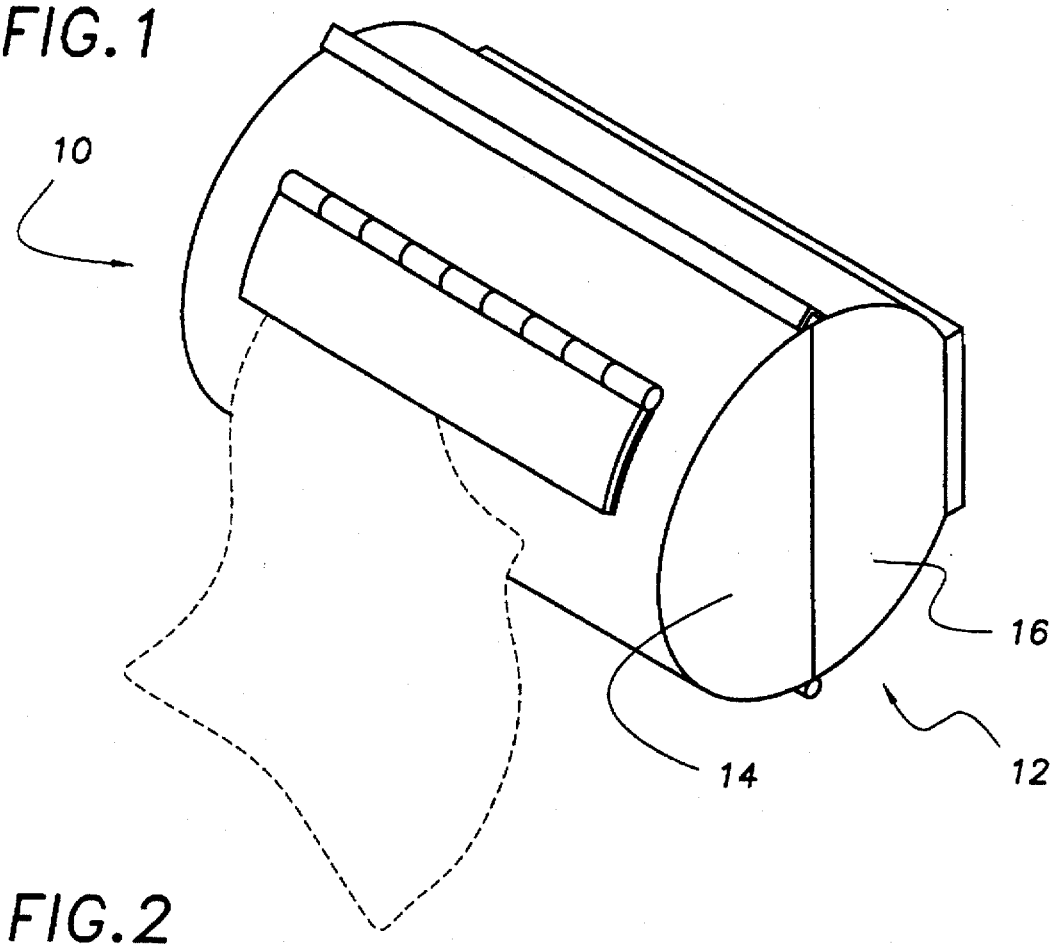
FIG. 1 is a perspective view of an exemplary embodiment of the baby bottle liner dispensing cabinet of the invention showing the sanitary door member in the covering configuration.
Figure 2:
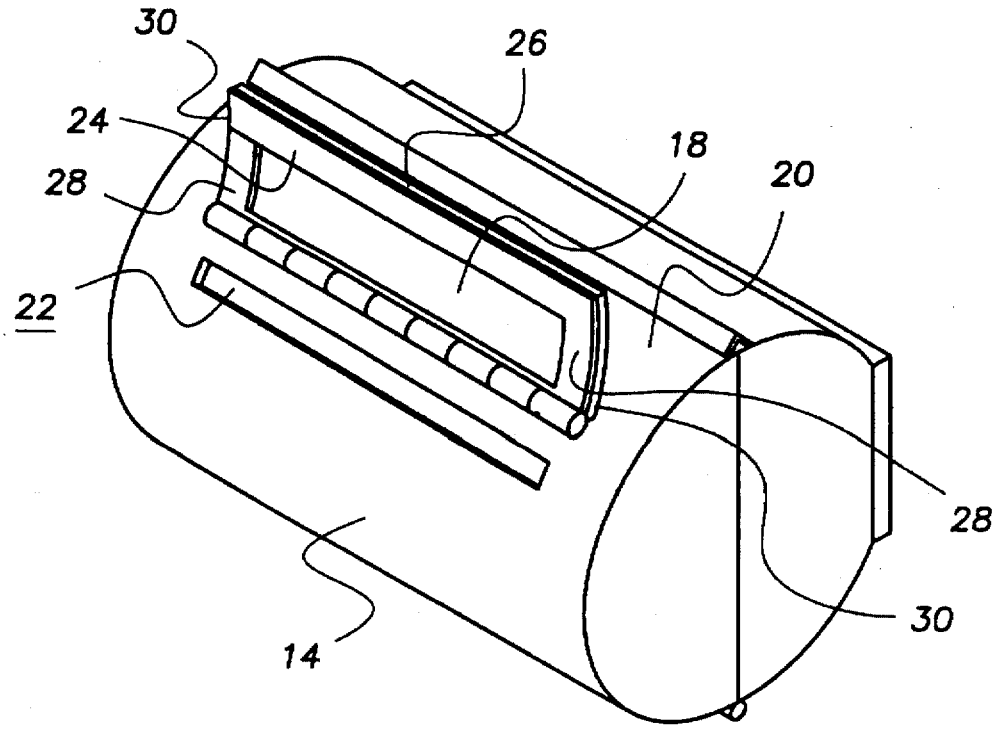
FIG. 2 is a perspective view of the dispensing cabinet of FIG. 1 with the sanitary door member rotated back from the covering configuration revealing the dispensing slot through the front housing member and the positive force latch plate on the underside of the sanitary door member.

FIG. 1 shows an exemplary embodiment of the baby bottle liner dispensing cabinet of the invention generally designated by the numeral 10. Dispensing cabinet 10 includes a plastic housing enclosure, generally designated by the numeral 12, having a front housing member 14 hingedly connected to a back housing member 16. With reference to FIG. 2, a sanitary door member 18 is pivotally secured to the exterior surface 20 of front housing member 14 adjacent a dispensing slot 22 formed through front housing member 14. Sanitary door member 18 includes a one-sixteenth (1/16") inch thick, elongated section 24 of steel secured along a distal edge 26 thereof. Two side gaskets 28 are secured along the side edges 30 of sanitary door member 18 to form a four sided cover over dispensing slot 22 when sanitary door member 18 is rotated thereover.

Figure 3:
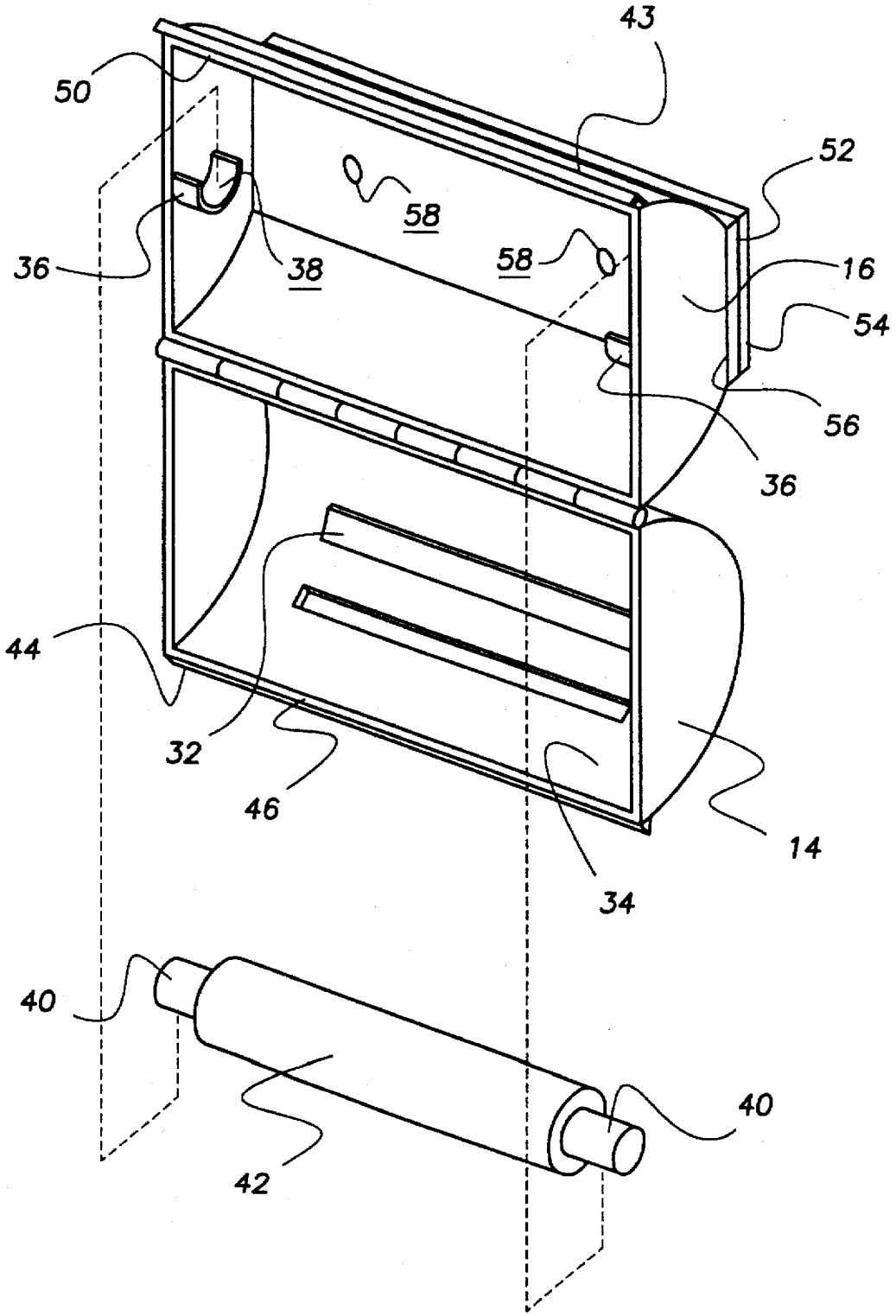
FIG. 3 is a partially exploded view of the dispensing cabinet of FIG. 1 showing the front housing member pivoted away from the back housing member to reveal the liner roll cavity including the two dowel retaining supports, the roll support dowel, and the magnetic strip of the positive force latching mechanism.

With reference to FIG. 3, an elongated section 32 of magnet is secured to an interior surface 34 of front housing member 14 at a location that coincides with the position of section 24 of steel when sanitary door member 14 is positioned over dispensing slot 22. Also shown in the figure are a pair of dowel retaining supports 36 secured to interior sidewalls of back housing member 16. Retaining supports 36 have an arcuate receiving cavity 38 for receiving and rotatably holding dowel ends 40 of a liner roll support dowel 42.

A closure protrusion 44 is provided along a first far edge 46 of front housing member 14 that engages a closure lip 48 provided along a second far edge 50 of back housing member 16 to secure front and back housing members 14,16 in the dispensing configuration. A section of mounting adhesive 52, covered with a removable cover tape 54, is provided on a substantially planar portion 56 of the exterior of back housing member 16. Two mounting apertures 58 are provided through back housing member 16 if a more permanent attachment method, such as the use of screws or nails, is preferred.

Figure 4:
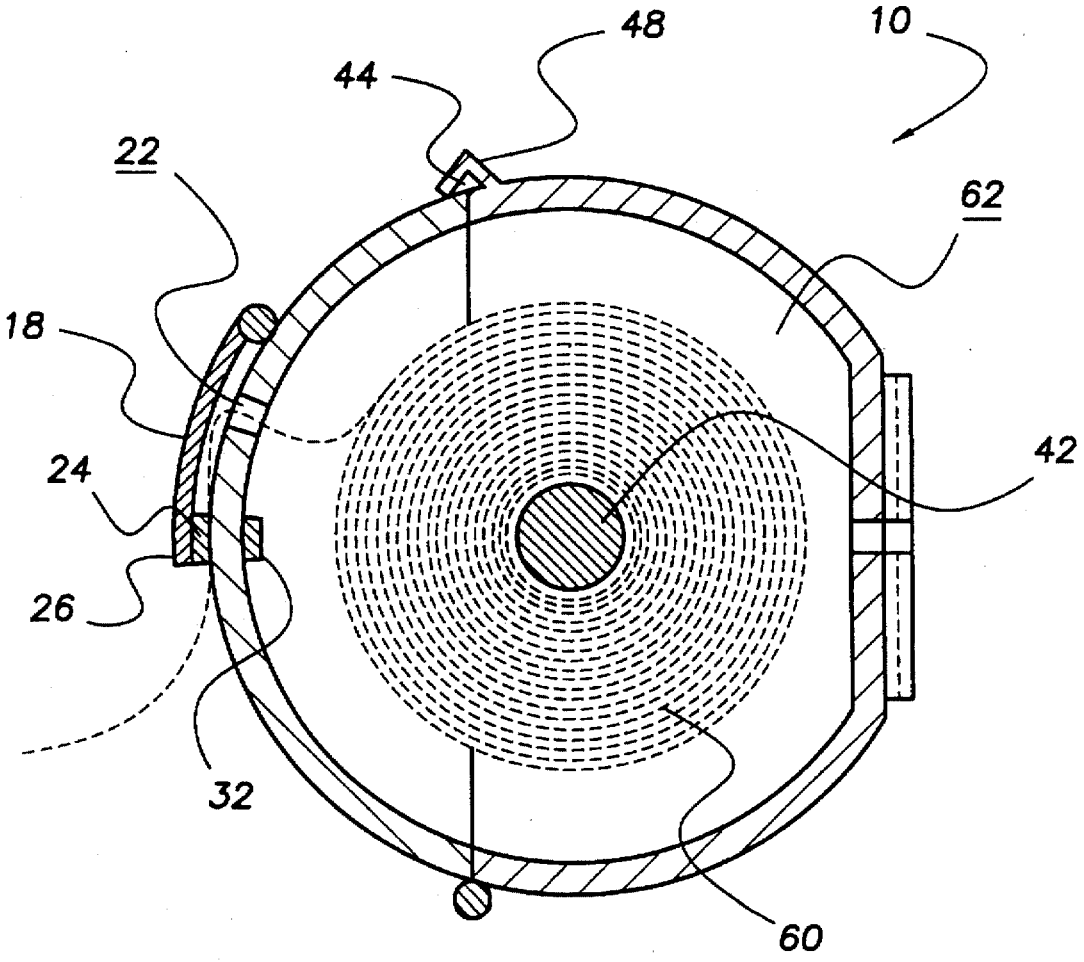
FIG. 4 is a cross-sectional view of the dispensing device of FIG. 1 showing a representative roll of baby bottle liners disposed over the roll support dowel and enclosed within the liner roll cavity with one baby bottle liner threaded through the dispensing slot and the end thereof held in place by the sanitary door member.

FIG. 4 is a cross-sectional view of dispensing cabinet 10 showing a representative roll of baby bottle liners 60 disposed over roll support dowel 42 and enclosed within a liner roll cavity 62 formed by snapping closure protrusion 44 into closure lip 48. Also shown in the figure is the position of section 24 of steel with respect to section 32 of magnet when sanitary door member 18 is positioned over dispensing slot 22. One baby bottle liner is threaded through dispensing slot 22 and a portion thereof is held in place by sanitary door member 18. In this embodiment, dispensing slot 22 is positioned about one and one-half (1½") inch from distal edge 26 of sanitary door member 18. This distance is sufficient to prevent a free end of bottle liner roll 60 from pulling back through dispensing slot 22 and into liner roll cavity 62.

Use of baby bottle liner dispensing cabinet 10 is now described with general reference to FIGS. 1–4. Dispensing cabinet 10 is filled with roll 60 of baby bottle liners by inserting roll support dowel 42 through the center thereof and then placing dowel ends 40 into receiving cavity 38 of dowel retainer supports 36. A free end of roll 60 is then inserted through dispensing slot 22 and pulled through until the edge thereof is aligned with distal edge 26 of sanitary door member 18. Front housing member 14 is then rotated upward until closure protrusion 44 is snapped under closure lip 48. Individual bottle liners may then be removed as desired by positioning the perforations located between adjacent bottle liners beneath distal edge 26 and then rapidly tearing the last bottle liner upward against distal edge 26 tearing the bottle liner free from roll 60.

If desired, dispensing cabinet 10 may be mounted to a flat surface by removing cover tape 54 from adhesive section 52 and pressing adhesive section 52 against the flat surface. Alternatively, dispensing cabinet 10 may be anchored with a pair of screws inserted through mounting apertures 58 and screwed into an available support.

It can be seen from the preceding description that a baby bottle liner dispensing cabinet has been provided that includes an enclosure for housing a roll of baby bottle liners that prevents contact between the roll and contaminants; that allows an individual liner to be removed from the roll without necessitating contact between the user and the roll; that includes a mechanism for allowing the user to mount the device in a location convenient for the preparation of baby bottles; and that allows a user to remove an individual liner from the roll with the use of a single hand.

It is noted that the embodiment of the baby bottle liner dispensing cabinet described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A baby bottle liner dispensing cabinet comprising:

a housing enclosure having a front housing member hingedly connected to a back housing member, said front housing member and said back housing members being positionable in combination to form an internal bottle liner roll cavity, said front housing member having a dispensing slot formed therethrough and in connection with said internal bottle liner cavity:

a liner roll support dowel positioned within said internal bottle liner roll cavity and rotatably mounted therein by a pair of dowel retainer supports secured to interior sidewalls of said back housing member, each of said dowel retaining supports having an arcuate receiving cavity for receiving and rotatably holding an end of said liner roll support dowel;

a roll of baby bottle liners including a plurality of sequentially attached baby bottle liners, said roll of baby bottle liners being rotatably mounted on said liner roll support dowel, a free end of said plurality of sequentially attached baby bottle liners being positioned through and extending past said dispensing slot;

a sanitary door member pivotally secured to an exterior surface of said front housing member adjacent said dispensing slot; and a positive force latching mechanism acting between said sanitary door member and said front housing member in a manner such that said sanitary door member is held in a first predetermined position over said dispensing slot with a portion of said free end of said plurality of sequentially attached baby bottle liners held between said sanitary door member and a portion of said second exterior surface of said front housing member by a positive force at least equal to a gravitational force on said sanitary door member, said positive force latching mechanism including a first section of magnetic material and a second section of material that is attracted by magnetic force, one of said first and second sections being secured to said sanitary door member alone a distal edge thereof, said other section secured to said front housing member at a location on said one of said first and second sections and in a manner such that magnetic forces acting through said portion of said free end of said plurality of sequentially attached baby bottle liners and between said first and second sections hold said portion of said free end of said plurality of sequentially attached baby bottle liners between said sanitary door member and said front housing member.

2. The baby bottle liner dispensing cabinet of claim 1, wherein:

said sanitary door member further includes two side gaskets secured along first and second side edges of said sanitary door member in a manner to form a four sided cover over said dispensing slot when said sanitary door member is rotated thereover.

3. The baby bottle liner dispensing cabinet of claim 2 wherein:

said front housing member includes a closure protrusion along a first far edge; and said back housing member includes a closure lip along a second far edge.

4. The baby bottle liner dispensing cabinet of claim 3 wherein:

said back housing member has a substantially planar exterior surface portion, and said exterior surface portion has a section of mounting adhesive, covered with a removable cover tape, disposed thereon.

5. The baby bottle liner dispensing cabinet of claim 4 wherein:

said back housing member has a first pair of apertures formed through said planar exterior surface portion; and said section of mounting adhesive has a second pair of apertures formed therethrough and concentrically aligned with said first pair of apertures.

6. The baby bottle liner dispensing cabinet of claim 1 wherein:

said front housing member includes a closure protrusion along a first far edge; and said back housing member includes a closure lip along a second far edge.

7. The baby bottle liner dispensing cabinet of claim 6 wherein:

said back housing member has a substantially planar exterior surface portion, and said exterior surface portion has a section of mounting adhesive, covered with a removable cover tape, disposed thereon.

8. The baby bottle liner dispensing cabinet of claim 7 wherein:

said back housing member has a first pair of apertures formed through said planar exterior surface portion; and said section of mounting adhesive has a second pair of apertures formed therethrough and concentrically aligned with said first pair of aperture.

9. The baby bottle liner dispensing cabinet of claim 1 wherein:

said back housing member has a substantially planar exterior surface portion, and said exterior surface portion has a section of mounting adhesive, covered with a removable cover tape, disposed thereon.

10. The baby bottle liner dispensing cabinet of claim 9 wherein:

said back housing member has a first pair of apertures formed through said planar exterior surface portion; and said section of mounting adhesive has a second pair of apertures formed therethrough and concentrically aligned with said first pair of apertures.

* * * * *